US007197849B2

(12) United States Patent
Liang et al.

(10) Patent No.: US 7,197,849 B2
(45) Date of Patent: Apr. 3, 2007

(54) BALANCE SHOE FOR TILT WINDOWS

(75) Inventors: Luke K. Liang, Irvington, NJ (US); Tong Liang, Guangzhou (CN)

(73) Assignee: Vision Industries Group, Inc., South Plainfield, NJ (US)

( * ) Notice: Subject to any disclaimer, the term of this patent is extended or adjusted under 35 U.S.C. 154(b) by 0 days.

(21) Appl. No.: 10/623,121

(22) Filed: Jul. 18, 2003

(65) Prior Publication Data

US 2005/0011127 A1 Jan. 20, 2005

(51) Int. Cl.
*E05D 15/22* (2006.01)

(52) U.S. Cl. ..... 49/181; 49/176

(58) Field of Classification Search ..... 49/176, 49/181, 183, 445; 16/193, 197
See application file for complete search history.

(56) References Cited

U.S. PATENT DOCUMENTS 4,068,406 A * 1/1978 Wood ..... 49/181
4,610,108 A * 9/1986 Marshik ..... 49/181
4,718,194 A * 1/1988 FitzGibbon et al. ..... 49/181
5,127,192 A * 7/1992 Cross ..... 49/181
5,251,401 A * 10/1993 Prete et al. ..... 49/181
5,371,971 A * 12/1994 Prete ..... 49/380
5,924,243 A * 7/1999 Polowinczak et al. ..... 49/181
6,332,288 B1 * 12/2001 Guillemet et al. ..... 49/181
6,550,184 B1 * 4/2003 O'Donnell et al. ..... 49/181
6,886,295 B2 * 5/2005 Annes et al. ..... 49/181
2003/0121207 A1 * 7/2003 O'Donnell et al. ..... 49/181

* cited by examiner

*Primary Examiner*—Jerry Redman

(57) ABSTRACT

The present invention teaches an improved balance shoe. The improved balance shoe of the present invention comprises a balance shoe housing for retaining a sash in a channel of a window. The housing can have a base section and at least one side section. A pivot member can be employed by the housing. Upon rotation, the pivot member can force at least one side support member into contact with a side wall of a window jamb channel when the window is tilted.

39 Claims, 6 Drawing Sheets

BALANCE SHOE FOR TILT WINDOWS

BACKGROUND OF THE INVENTION

Proper ventilation has become a necessity both at home and in the workplace. Most commonly, a homeowner will require proper ventilation when painting a room or finishing a floor within his or her home. Ventilation, especially the ability to allow for a cross-breeze within the work area, will alleviate the build-up of toxic fumes while allowing the paint or finish to dry quicker.

Factories and construction sites are also in need of proper ventilation. Factories manufacture chemicals in extremely large quantities, and must prevent build-up of fumes. Construction sites are most always filled with dust and debris, which if inhaled, can be extremely hazardous to a worker's health.

Many improvements in windows have occurred over the years, which have gone beyond simple vertical movement. Today, windows can be opened along a vertical axis, similar to opening a door. Also, windows can be extended off their frames, similar to opening a hatch on a boat. However, most of the improvements with windows have made use of a device in the channel of a window frame that allows the window sash to pivot. Thus, the window can be tilted outward from the top or bottom depending where the pivotable sash is placed. Also, these devices have allowed users to maintain a window in a tilted position.

The use of a pivotable window sash has had many advantages. Windows can be easily replaced if the pane becomes cracked. Also, because they are easily removable, the windows can be taken out to be cleaned. Or, the window can be tilted and maintained in a fixed position for cleaning.

U.S. Pat. No. 4,610,108 discloses a device for maintaining a tilt-out window in a fixed position. However, the cam member which engages the window sash is very difficult to turn because of the great compressive force placed on it by the spring member. Also, the serrated portion of the spring member may strip the vinyl surface of the window channel if the window begins to slip, or force is placed on the window when it is in the tilted position.

One type of pivotable sash balance brake or shoe is shown in U.S. Pat. No. 5,371,971. This patent relates to a lock where the pivot pin extends outwardly from the window sash. The sash balance brake is disposed within a track in the window frame and includes a cam rotatably disposed within an expandable housing. The pivot pin has a collar for lateral engagement with the cam to prevent the window frame from bowing away from the window sash, thereby maintaining the window frame substantially square. The cam in this lock is disposed within an expandable housing. The pivot pin is received by the U-shaped cavity of the cam, such that rotation of the pivot pin upon pivoting of the sashes rotates the cam, thereby expanding the expandable housing to thereby lock the housing in its place and in its respective track. The cam also has a solid circular covering corresponding generally to the shape of a side housing opening, which is also substantially circular.

Another type of pivotable sash balance brake or shoe is found in Ashland's U.S. Pat. No. 5,806,243. In this patent the sash balance brake assembly comprises a rotor having a rotor camming surface and being rotatable about a rotor axis. A slider body is placed in one of the channels for coupling to one of the sash balance assemblies. The slider body includes means for rotatably supporting the rotor such that the camming surface is directed outwardly towards the respective outer wall. A bolt is provided having a bolt camming surface in operative engagement with the rotor camming surface, such that rotation of the rotor moves the bolt along the rotor axis and into engagement with the outer wall.

SUMMARY OF THE INVENTION

The present invention is concerned with a pivotable window sash. The shoe of the present invention has a locking take out and drop in feature. When the sash is tilted approximately 90 degrees the whole sash can be taken out of the frame and readily dropped back in since the cam is in an open position in that configuration. When the sash is returned to a generally vertical position within the window frame, the "T" shaped pivot bars are locked in the cam of the shoes. This prevents the window from bowing out during transportation. The "T" shaped bars pull the window frame together through the cams of the shoe.

The invention comprises a preferably rectangular balance shoe housing which fits into a window jamb channel. The balance shoe housing can be made out of any material, but preferably plastic is used so the device can move relatively frictionlessly within the channel.

The balance shoe housing utilizes a pivot member with a preferably oval-shaped top portion. The bottom portion of the pivot member receives the head of a pivot bar whose other end is fixed to a window sash. Thus, when the window is tilted, the pivot bar forces the pivot member to rotate within the balance shoe housing.

The window typically rides in a generally U-shapes channel, i.e., having a base section with a first end and a second end and two side sections extending from the same side of the base section. When the pivot member rotates, the oval-shaped top portion forces at least one side support member into the inner surface of the window jamb channel, i.e., one or both of the side sections. Thus, the side support member is under compressive force between the pivot member and window jamb channel when the pivot member rotates. This compressive force allows a user to tilt a window at any point along its vertical movement within the window frame.

When the pivot member is rotated back, and the window has returned to a resting, vertical position, the side support member retracts and becomes generally flush with the surface of the balance shoe housing, i.e., does not interfere with the travel of the window as the window is raised and lowered. Thus, the window can easily be moved vertically within the frame and tilted at any point in its vertical movement. And, while the window is tilted, it will be held firmly in place by the side support member of the balance shoe.

DETAILED DESCRIPTION OF THE DRAWINGS

Figures 1, 2, 3, 4:
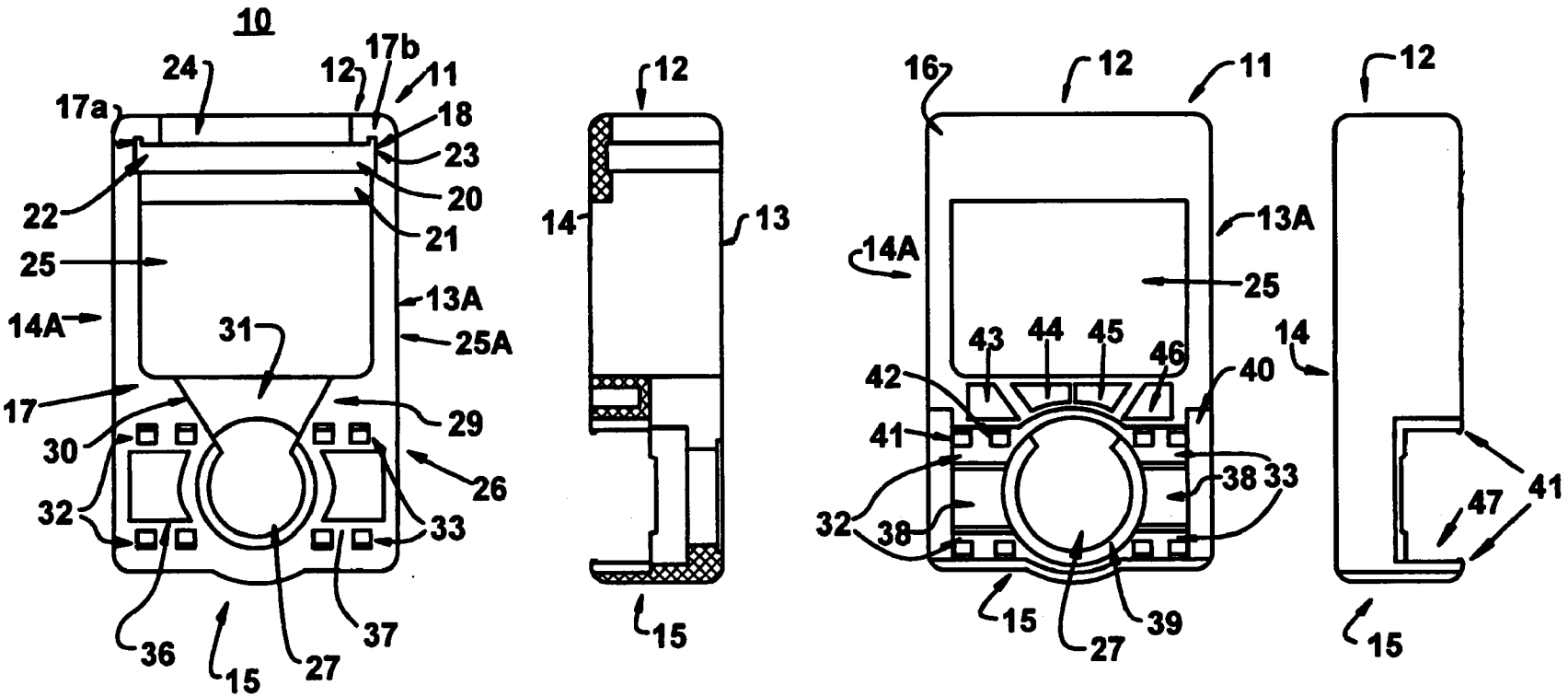
FIG. 1 is a bottom view of the balance shoe housing of the present invention.
FIG. 2 is a cross-sectional view of the balance shoe housing of the present invention.
FIG. 3 is a top view of the balance shoe housing of the present invention.
FIG. 4 is a side view of the balance shoe housing of the present invention.
Figure 1A:
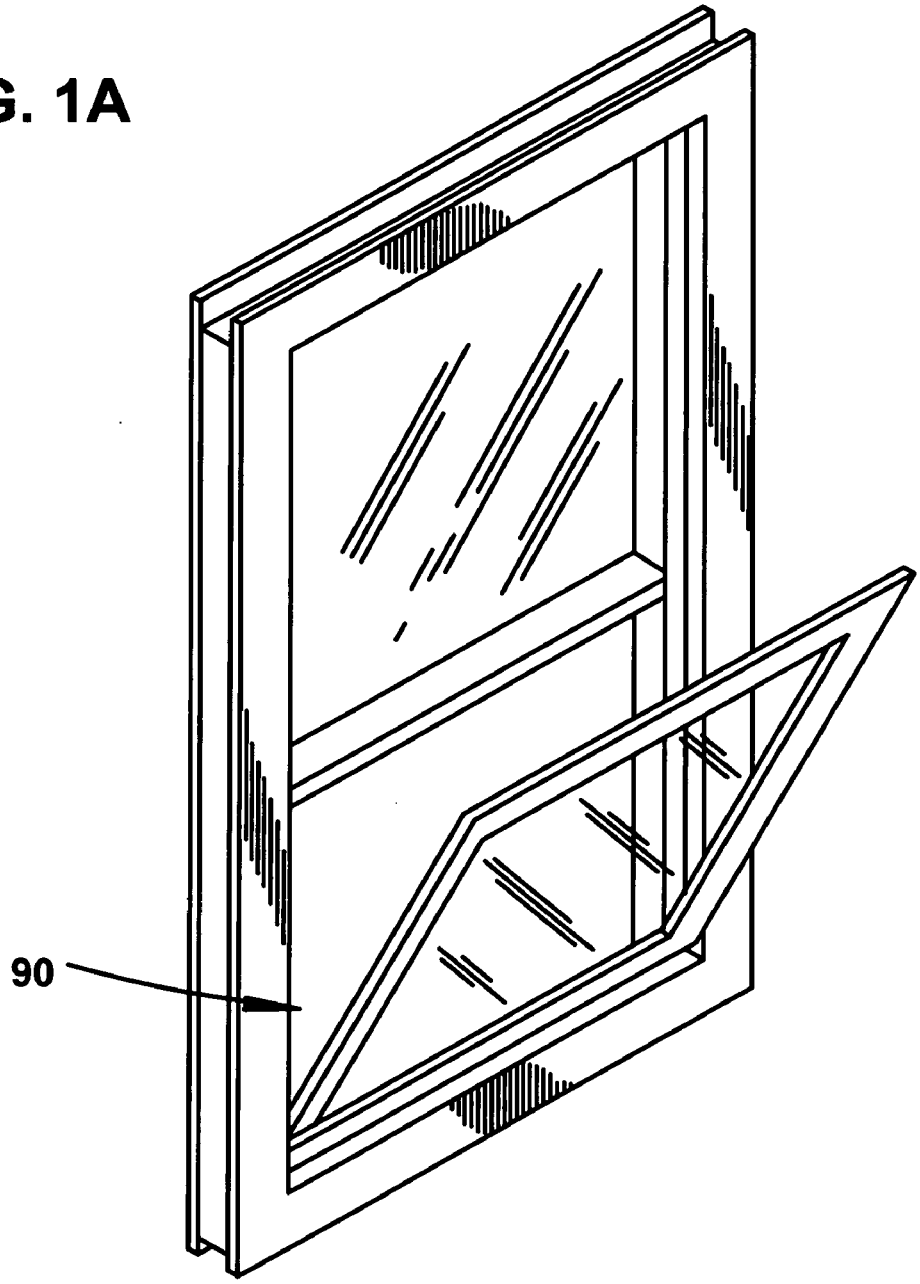

The present invention 10 is comprised of a balance shoe housing 11 which is preferably made of plastic, wood, metal or suitable material. The balance shoe 11 may be generally rectangular with a top surface 12, side surfaces 13 and 14, and a bottom surface 15. The balance shoe 11 also has a front outer surface 16 and a rear inner surface 17. The balance shoe is designed to fit in window jamb channels where the window sash normally rides vertically. The window jamb channels are generally U-shaped and receive the sides of the sash and hold them in place.

The use of plastic for the balance shoe allows the balance shoe to move relatively frictionlessly within the jamb channel. The preferably rectangular design gives the window support as it slides and when it pivots.

As seen in FIG. 1, the rear inner surface and interior sidewalls 17*a* and 17*b* of balance shoe 11 have generally rectangular receiving means 18 which houses a stability member 19. The receiving means has a deep surface 20 and a shallow surface 21. The receiving means also has a first slot 22 and a second slot 23, which facilitate in maintaining the stability member in a fixed position between sides 13 and 14 of the balance shoe housing 11. The stability member is preferably made of a material with a greater stiffness than the plastic of the balance shoe, such as for example stainless steel.

The top surface 12 of the balance shoe housing 11 has a generally rectangular cut-out 24. However, the top edges 13 and 14*a* of side surfaces 13 and 14 are preferably continuous with the housing top edge 12*a* of top surface 12.

In the center portion 25A of the balance shoe housing 11, may be an opening, which can be a generally rectangular hole or opening 25. Hole 25 may extend entirely from front outer surface 16 to rear inner surface 17. Hole 25 may be any shape or depth that a manufacturer desires.

In the lower portion 26 of the balance shoe housing is a second hole 27, which is generally circular. This hole 27 receives the pivot member 28. The pivot member will engage with a pivot bar that is fixed to the window sash. Side diagonal cuts 29 and 30, along with upper diagonal cut 31, can act as guides to direct the "T"-shaped head of the pivot bar to easily slide into pivot member 28. These cuts need not be diagonal as long as they provide a channel or space for the head of the pivot bar to be secured in the pivot member.

Also, on the inner surface 17 of the balance shoe 11 are a pair of receiving channels 32 and 33. Receiving channels 32 and 33 allow the retaining arm 34 of the side support member 35 to move freely in a horizontal direction. The receiving channels are cut completely through the balance shoe. Thus, the retaining arm may be of any length to offer more support to the side support member. However, the channels need only be as deep as the retaining arm is long. There may be cut outs, 36 and 37 which are located on the rear inner surface 17 of the bottom portion 26 of the balance shoe housing 11. These cut outs are not necessarily required to pierce the outer surface 16 of the balance shoe housing 11. Thus, these cuts may be of any depth or shape as long as they do not affect the functioning of the device.

As seen in FIG. 3, hole 27 has a first ledge 38 and a second ledge 39. Side support member 35 rides along ledge 38, while pivot member 28 is placed in hole 27 and the pivot member rests on second ledge 39. Also, on front outer surface 16 are retaining means 40. Each channel is comprised of a first retaining means 41 and a second retaining means 42. Retaining means 41 and 42 guide side support member 35 when it is moving horizontally away and toward hole 27. The retaining means may be of any number so long as they hold the side support member in place while it is moving horizontally. Cut-outs 43, 44, 45 and 46 are also on the front outer surface 16 of balance shoe 11. These cut-outs are not required to pierce the rear inner surface 17 of the balance shoe housing.

Each side surface 13 and 14 contains a generally rectangular cut-out 47 which is cut in a manner to house the side support member 35.

Figure 8:
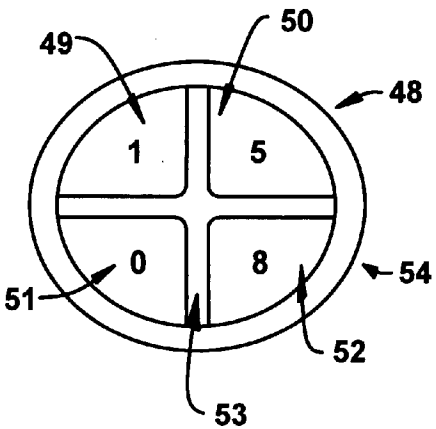
FIG. 8 is a top view of the pivot member of the present invention.
Figure 7:
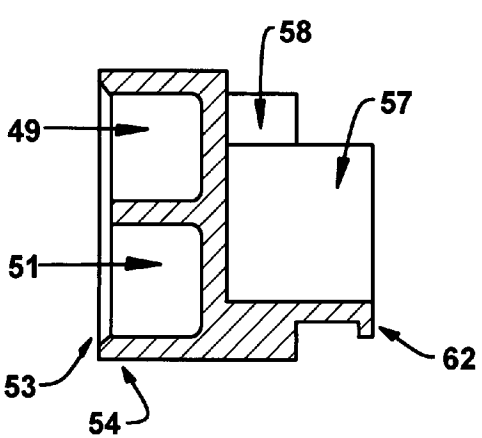
FIG. 7 is a cross-sectional view of the pivot member of the present invention.

As seen in FIG. 8, pivot member 28 has a generally oval head portion 48. Head portion 48 is divided into four quadrants 49, 50, 51 and 52, which are separated by cross-member 53. Cross member 53 only provides head portion 48 with additional support and may be any shape that accomplishes that function. The head portion may be any shape, as long as when the window is vertical, the side support members are flush with sides 13 and 14 of the balance shoe. And, when the window is pivoted, side support members are forced against the surface of the jamb channel by the rotation of the pivot member. Head wall 54 surrounds the four quadrants.

Pivot member 28 also has a middle portion 55 and a lower portion 56, which are both generally circular. However, middle portion and lower portion have a generally rectangular cut out 57. Cut out 57 runs completely through middle portion 55, but only to an outer surface, of lower portion 56. Also, on middle portion 55 are diagonal cuts, 58 and 59 which facilitate engagement of the T-shaped head of the pivot bar, which fits into the cut-out 57 in the middle portion 55 of the pivot member 28. The cut out 57 need only be shaped to hold the head of the pivot bar in place when the window is tilted. Thus, if the head of the pivot bar is L-shaped, the cut out 57 need not run completely through the middle portion.

Figure 6:
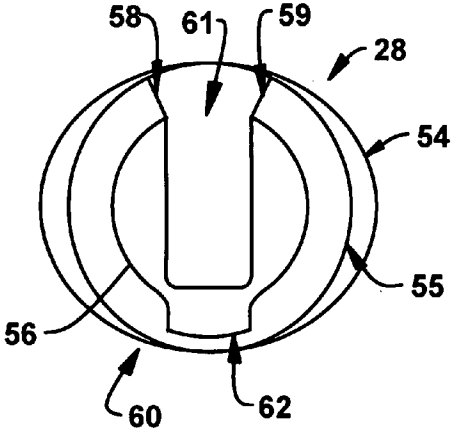
FIG. 6 is a bottom view of the pivot member of the present invention.
Figure 5:
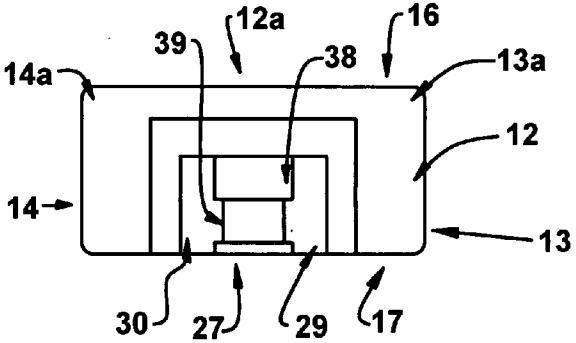
FIG. 5 is a front view of the balance shoe housing of the present invention.
Figure 9:
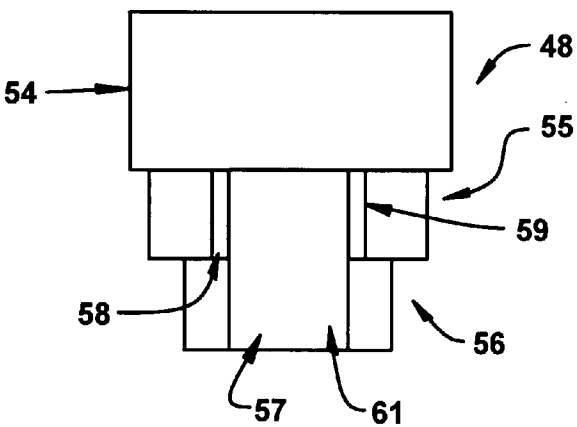
FIG. 9 is a side view of the pivot member of the present invention.
Figure 11:
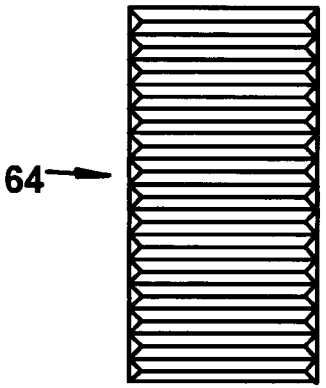
FIG. 11 is a side view of the side support member of the present invention.

At the back 60 of lower portion 56 opposite the opening 61 of cut out 57 is retaining tab 62. As seen in FIG. 6, retaining tab 62 is preferably rectangular. The retaining tab 62 holds pivot member 28 in place in hole 27 of the balance shoe housing 11. Thus, the pivot member 28 will be secured in hold 27 if a window sash is being pivoted or a window frame is attempting to be released from the balance shoe housing 11. The retaining tab may be any size or shape, but need be small enough to fit through diagonal cuts 29 and 30 when the pivot member 28 is being taken out of the balance shoe for replacement or cleaning.

Figure 10:
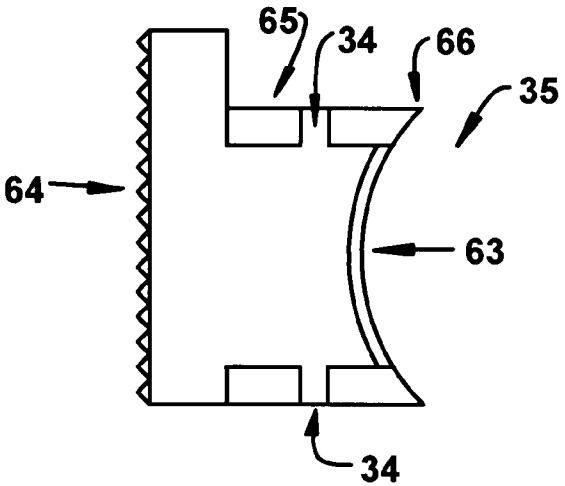
FIG. 10 is a top view of the side support member of the present invention.
Figure 12:
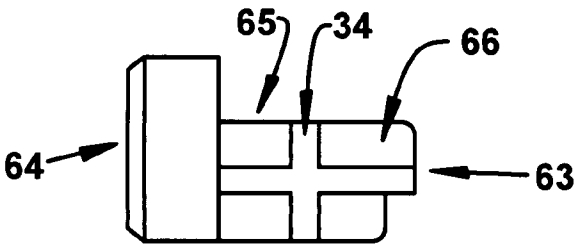
FIG. 12 is a front view of the side support member of the present invention.

Side support member 35 is clearly shown in FIG. 10. Side support member 35 has an inner arcuate surface 63 which articulates with the oval head portion 48 of pivot member 28. Thus, when the pivot member is rotated, the oval design forces the side support member 35 into the inner surface of the window jamb channel. The compressive force generated by the oval head 48 pressing the side support member 35 into the inner surface of the window jamb channel allows the window to be locked into place at any position along its vertical frame when tilted.

Side support member 35 has serrated surface 64, which frictionally engages the inner surface of the window jamb channel. Obviously, this surface 64 may be flat, as not serrated, or may have any raised pattern that will allow the side support member 35 to better engage the inner surface of the window jamb channel.

The side support member 35 may extend a fixed distance away from the balance shoe housing 11 due to at least one retaining arm 34. Retaining arm 34 fits between retaining means 41 and 42. Thus, when the window is in a vertical position within the frame, retaining arm 34 is positioned up against retaining means 42; when, the window is tilted, the retaining arm 34 moves horizontally until it is slopped by retaining means 41.

On both sides of the retaining arm 34 are depressions 65 and 66. These depressions maintain a space for retaining means 41 and 42.

Figure 13:
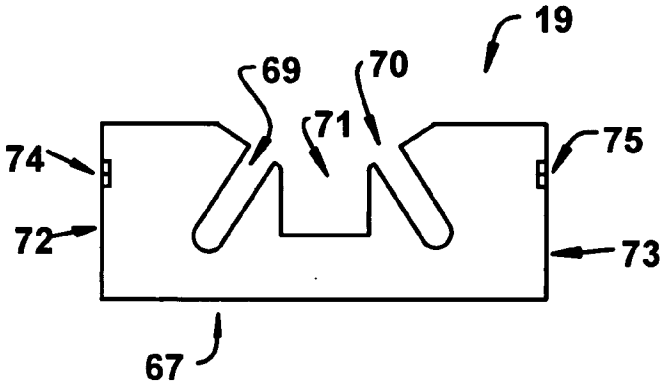
FIG. 13 is a front view of the stability member of the present invention.
Figure 14:
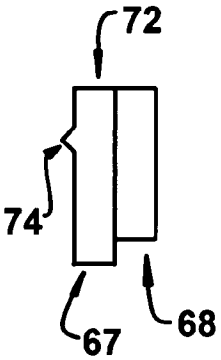
FIG. 14 is a side view of the stability member of the present invention.
Figure 15:
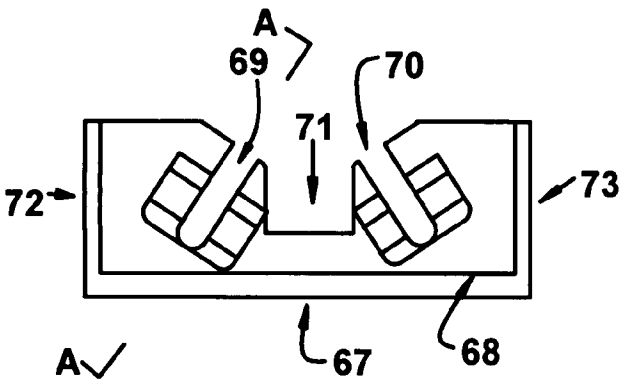
FIG. 15 is a back view of the stability member of the present invention.

As seen in FIG. 13, stability member 19 may have a generally rectangular shape. The bottom edge 67 of the stability member 19 fits into the deep surface 20 of the balance shoe housing 11. A second bottom edge 68 fits into the shallow surface 21 of the balance shoe housing 11.

Figure 17:
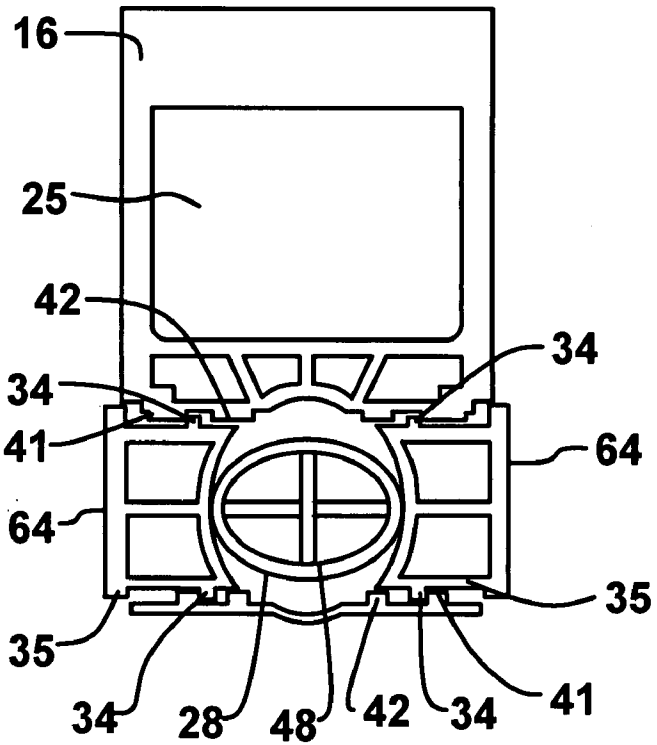
FIG. 17 shows the top view of the balancing shoe housing with pivot member and side support members attached; pivot member is rotated 90 degrees and both side support members extended.
Figure 16:
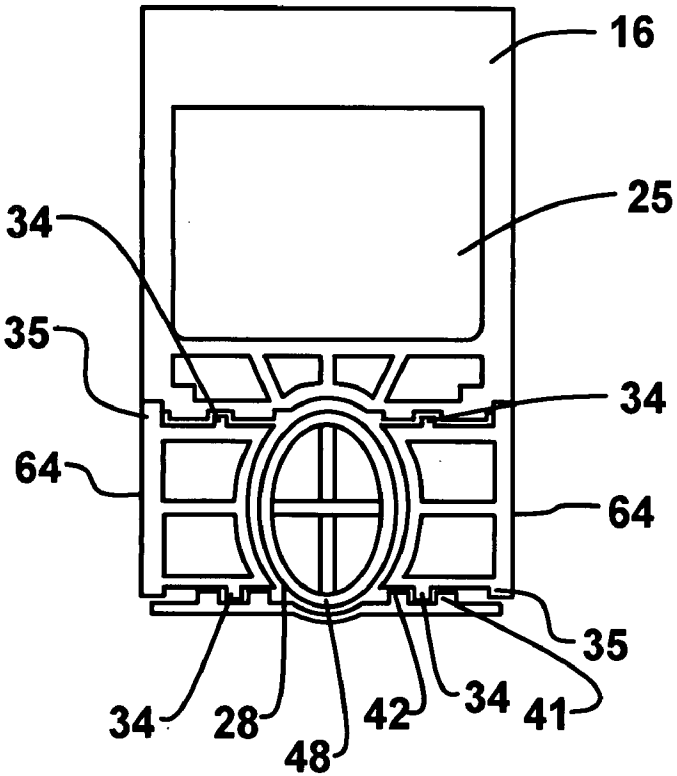
FIG. 16 shows the top view of the balancing shoe housing with pivot member and side support members attached; pivot member is in non-rotated position.

Side support member 35 is clearly shown in FIGS. 10, 16 and 17. Side support member 35 has an inner arcuate surface 63 which articulates with the oval head portion 48 of pivot member 28. Thus, when the pivot member is rotated, the oval design forces the side support member 35 into the inner surface of the window jamb channel. The compressive force generated by the oval head 48 pressing the side support member 35 into the inner surface of the window jamb channel allows the window to be locked into place at any position along its vertical frame when tilted.

Along side edges 72 and 73 of stability member 19 are retaining members 74 and 75. When stability member 19 is placed in balance shoe housing 11, retaining members 74 and 75 fit into slots 22 and 23. Similarly, the retaining means prevent the stability member from coming loose from the balance shoe housing.

FIG. 16 shows the outer surface 16 of the balance shoe housing 11 with the pivot member 28 inserted into the aperture 27. When the pivot member 28, and therefore, the oval head portion of such pivot member 48 is rotated, as shown in FIG. 17, the extended sides of the head portion 48 push outwardly both side support members 35 to frictionally engage the inner surface of the window jamb channel. It is evident that the maximum pressure toward such inner surface would be applied when the oval-shaped head portion 48 of the pivot member 28 is positioned approximately 90 degrees relative to the position of such pivot member depicted in FIG. 16. It is also evident from FIG. 17 that both retaining means 41 and 42 would limit the movement of the side support members 35 engaging the retaining arm 34.

The invention claimed is:

1. An improved balance shoe said balance shoe for retaining a window sash in a window jamb channel comprising:

a balance shoe housing having a base section, said base section having at least one channel and at least one side support member slidably movable in said channel from a first position to a second extended position, said channel having a first retaining means and a second retaining means extending from a first surface of said channel, said side support member having a retaining arm that moves between said first and second retaining means as said side support member moves from said first position to said second position;

said balance shoe housing having a pivot member, said pivot member having a generally oval-shaped head portion and wherein said oval-shaped head portion engages at least one of said side support members as said oval-shaped portion rotates and forces said side support member of said balance shoe housing to slide in said channel from said first position to said second extended position such that when said balance shoe is in a window sash said side support member is in contact with at least one side wall surface of said window jamb channel when said side support member is in its second extended position and said window sash is tilted.

2. The balance shoe according to claim 1 wherein one or more guides direct the pivot bar to easily slide into pivot member.

3. The balance shoe according to claim 1 wherein said side support member has an inner arcuate surface which articulates with said oval head portion as said oval-shaped head portion rotates.

4. The balance shoe according to claim 3 wherein said side support member has a serrated surface which engages said window jamb channel when said side support member is in an extended position.

5. The balance shoe according to claim 1 wherein said balance shoe has a first open portion and a second open portion, said second open portion having a rear inner surface an interior top wall and an interior bottom wall and first and second interior side walls, said rear inner surface and said interior walls forming a receiving means for housing a stability member, said interior top wall having a first recess at one end thereof and a second recess at the opposite end thereof.

6. The balance shoe according to claim 1 wherein said housing has an upper diagonal cut and a first and second side diagonal cuts on opposite sides thereof to guide said pivot into said pivot member.

7. The balance shoe according to claim 1 a third retaining means and fourth retaining means on a second inside surface of said channel and wherein said side support member has a second retaining arm; said first retaining arm being between said first retaining means and said second retaining means and said second retaining arm being between said third retaining means and said fourth retaining means.

8. The balance shoe according to claim 1 wherein said pivot member has a front surface and a back surface said back surface having a retaining tab to hold said pivot member in position in said balance shoe housing.

9. The balance shoe housing according to claim 1 wherein said side support member has a recess on each side of said retaining arm.

10. The balance shoe housing according to claim 1 wherein said housing has a recess formed by a rear inner surface and interior sidewalls at opposite ends of said rear inner surface and a separate stability member retained in said recess, said recess having a first region and a second region said first region being deeper than said second region, said stability member having a first bottom edge that fits into said first region and second bottom edge that fits into the second region.

11. The balance shoe housing according to claim 10 wherein said stability member has a first slot and a pair of diagonal slots on opposite sides of said first slot.

12. The balance shoe according to claim 11 wherein said stability member has a first and second a retaining member extending therefrom, said retaining members being received by slots in said housing.

13. An improved balance shoe comprising a balance shoe housing having a base section, said base section of said housing having an opening for receiving and retaining a pivot member said pivot member being adapted to engage a pivot bar attached to a window sash, said opening having a guide that directs the pivot bar into said pivot member, said guide having a diagonal wall, said diagonal wall having first and second side diagonal walls on opposite sides thereof to guide said pivot bar into said pivot member, said pivot member having a generally oval head portion, and wherein said oval head portion of said pivot member forces at least one side support member of said housing outwardly into contact with at least one sidewall surface of a window jamb channel when said window is tilted and wherein said base has a first surface on one side of said base and a second surface on the opposite side of said base and a sidewall between said first and second surfaces, said surfaces having at least a pair of receiving channels, said receiving channels extending from said first surface to said second surface to permit a retaining arm of the side support member to move freely in a first direction and a second direction in said receiving channel when said oval head portion of said pivot member rotates when said window is tilted.

14. The balance shoe according to claim 13 wherein the opening has a first ledge and a second ledge and said side support member rides along said first ledge and said pivot member is placed in said opening and pivot member rests on second ledge.

15. The balance shoe according to claim 13 wherein said balance shoe has a first open center portion and a second open portion, said second open portion having a rear inner surface an interior top wall and an interior bottom wall and first and second interior side walls, said rear inner surface and said interior walls forming a receiving means for housing a stability member, said interior top wall having a first recess at one end thereof and a second recess at the opposite end thereof.

16. The balance shoe according to claim 13 wherein said receiving channels have a first retaining means and a second retaining means on one inside surface of said channels and a third retaining means and fourth retaining means on a second inside surface of said channels and wherein said side support member has a first and second retaining arm; said first retaining arm being between said first retaining means and said second retaining means and said second retaining arm being between said third retaining means and said fourth retaining means.

17. The balance shoe according to claim 13 wherein said pivot member has front surface and a back surface said back surface having a retaining tab to hold said pivot member in position in said balance shoe housing.

18. The balance shoe housing according to claim 13 wherein said side support member has a recess on each side of said retaining arm.

19. The balance shoe housing according to claim 13 wherein said housing has a recess formed by a rear inner surface and interior sidewalls at opposite ends of said rear inner surface and a separate stability member retained in said recess, said recess having a first region and a second region said first region being deeper than said second region, said stability member having a first bottom edge that fits into said first region and second bottom edge that fits into the second region.

20. The balance shoe housing according to claim 19 wherein said stability member has first slot and a pair of diagonal slots on opposite sides of said first slot.

21. The balance shoe according to claim 20 wherein said stability member has side edges, said side edges having a first and second retaining member extending therefrom, said retaining members being received by slots in said housing.

22. An improved balance shoe said balance shoe for retaining a window sash in a window jamb channel comprising:

a balance shoe housing having a front outer surface and a rear inner surface and a pair of opposed side surfaces connecting said front and rear surfaces, a base section formed by a portion of said front outer and rear inner surface, said front outer surface having at least one channel, said channel having a first retaining means and a second retaining means extending from a surface of said channel, said channel having at least one side support member slidably movable in said channel from a first position to a second extended position, said side support member having a retaining arm that moves between said first and second retaining means as said side support member moves from said first position to said second position, said retaining arm being positioned against said first retaining means when a window is in a vertical position and against said second retaining means when said window sash is in a tilted position;

said balance shoe housing having a pivot member, said pivot member having a generally oval-shaped head portion and wherein said oval-shaped head portion engages at least one of said side support members as said oval-shaped portion rotates and forces said side support member of said balance shoe housing to slide in said channel from said first position to said second extended position such that when said balance shoe is in a window sash said side support member is in contact with at least one side wall surface of a window jamb channel when said side support member is in its second extended position and said window sash is tilted.

23. An improved balance shoe for retaining a window sash in a window jamb channel comprising:

a balance shoe housing having a front outer surface and a rear inner surface and a pair of opposed side surfaces connecting said front and rear surfaces, an upper section and a base section said upper section having a recessed portion, said recessed portion having a rear inner surface an interior top wall and an interior bottom wall and first and second interior side walls, said rear inner surface and said interior walls forming a receiving means for housing a stability member, said recess portion having a first region and a second region said first region being deeper than said second region, said stability member having a first bottom edge that fits into said first region and second bottom edge that fits into the second region, said stability member having a first slot and a pair of diagonal slots on opposite sides of said first slot, said stability member having a first and second a retaining member extending therefrom, said retaining members being received by recesses in said housing;

said base section having at least one channel, said channel having extending from a surface of said channel a first retaining means and an second retaining means, said channel having at least one side support member slidably movable in said channel from a first position to a second extended position, said side support member having a retaining arm that moves between said first and second retaining means as said side support member moves from said first position to said second position, said retaining arm being positioned against said first retaining means when said window sash is in a vertical position and against said second retaining means when said window is in a tilted position;

said balance shoe housing having a pivot member, said pivot member having a front surface and a back surface said back surface having a retaining tab to hold said pivot member in position in said balance shoe housing, said pivot member having a generally oval-shaped head portion and wherein said oval-shaped head portion engages at least one of said side support members as said oval-shaped portion rotates and forces said side support member of said balance shoe housing to slide in said channel from said first position to said second extended position wherein said side support member is in contact with at least one side wall surface of said windowjamb channel when said side support member is in its second extended position and said window sash is tilted.

24. An improved balance shoe comprising a balance shoe housing having a base section, said base section of said housing having an opening for receiving and retaining a pivot member said pivot member being adapted to engage a pivot bar attached to a window sash, said opening having a guide that directs the pivot bar into said pivot member, said guide having a diagonal wall said diagonal wall having first and second side diagonal walls on opposite sides thereof to guide said pivot bar into said pivot member, said pivot member having a generally oval head portion, and wherein said oval head portion of said pivot member forces at least one side support member of said housing outwardly into contact with at least one sidewall surface of a window jamb channel when said window is tilted and wherein said base has a first surface on one side of said base and a second surface on the opposite side of said base and a sidewall between said first and second surfaces, said surfaces having at least a pair of receiving channels, said receiving channels extending from said first surface to said second surface to permit a retaining arm of the side support member to move freely in a first direction and a second direction in said receiving channel when said oval head portion of said pivot member rotates when said window is tilted, wherein said receiving channels have a first retaining means and a second retaining means on one inside surface of said channels and a third retaining means and fourth retaining means on a second inside surface of said channels and wherein said side support member has a first and second retaining arm; said first retaining arm being between said first retaining means and said second retaining means and said second retaining arm being between said third retaining means and said fourth retaining means.

25. The balance shoe according to claim 24 wherein said balance shoe has a first open center portion and a second open portion, said second open portion having a rear inner surface an interior top wall and an interior bottom wall and first and second interior side walls, said rear inner surface and said interior walls forming a receiving means for housing a stability member, said interior top wall having a first recess at one end thereof and a second recess at the opposite end thereof.

26. The balance shoe according to claim 24 wherein said pivot member has front surface and a back surface said back surface having a retaining tab to hold said pivot member in position in said balance shoe housing.

27. The balance shoe housing according to claim 24 wherein said side support member has a recess on each side of said retaining arm.

28. The balance shoe housing according to claim 24 wherein said housing has a recess formed by a rear inner surface and interior sidewalls at opposite ends of said rear inner surface and a separate stability member retained in said recess, said recess having a first region and a second region said first region being deeper than said second region, said stability member having a first bottom edge that fits into said first region and second bottom edge that fits into the second region.

29. The balance shoe housing according to claim 28 wherein said stability member has first slot and a pair of diagonal slots on opposite sides of said first slot.

30. The balance shoe according to claim 29 wherein said stability member has side edges, said side edges having a first and second retaining member extending therefrom, said retaining members being received by slots in said housing.

31. The balance shoe according to claim 24 wherein the opening has a first ledge and a second ledge and said side support member rides along said first ledge and said pivot member is placed in said opening and pivot member rests on second ledge.

32. The balance shoe according to claim 24 wherein said side support member has an inner arcuate surface which articulates with said oval head portion as said oval-shaped head portion rotates.

33. The balance shoe according to claim 32 wherein said side support member has a serrated surface which engages said windowjamb channel when said side support member is in an extended position.

34. The balance shoe according to claim 24 wherein said balance shoe has a first open portion and a second open portion, said second open portion having a rear inner surface an interior top wall and an interior bottom wall and first and second interior side walls, said rear inner surface and said interior walls forming a receiving means for housing a stability member, said interior top wall having a first recess at one end thereof and a second recess at the opposite end thereof.

35. The balance shoe according to claim 24 wherein said housing has an upper diagonal cut and a first and second side diagonal cuts on opposite sides thereof to guide said pivot into said pivot member.

36. The balance shoe housing according to claim 35 wherein said side support member has a recess on each side of said retaining arm.

37. The balance shoe housing according to claim 36 wherein said housing has a recess formed by a rear inner surface and interior sidewalls at opposite ends of said rear inner surface and a separate stability member retained in said recess, said recess having a first region and a second region said first region being deeper than said second region, said stability member having a first bottom edge that fits into said first region and second bottom edge that fits into the second region.

38. The balance shoe housing according to claim 37 wherein said stability member has first slot and a pair of diagonal slots on opposite sides of said first slot.

39. The balance shoe according to claim 38 wherein said stability member has a first and second a retaining member extending therefrom, said retaining members being received by slots in said housing.

* * * * *